US007077091B2

(12) United States Patent
Hix et al.

(10) Patent No.: US 7,077,091 B2
(45) Date of Patent: Jul. 18, 2006

(54) POLYMER MATRIX COMPOSITE PUSHROD

(75) Inventors: Leland E. Hix, Eau Claire, WI (US); James P. Sorensen, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/950,076

(22) Filed: Sep. 24, 2004

(65) Prior Publication Data

US 2006/0065220 A1 Mar. 30, 2006

(51) Int. Cl.
*F01L 1/14* (2006.01)

(52) U.S. Cl. ..... 123/90.61; 123/90.62; 123/90.63; 123/90.64; 29/888.2

(58) Field of Classification Search ..... 123/90.61, 123/90.62, 90.63, 90.64; 29/888.2
See application file for complete search history.

(56) References Cited

U.S. PATENT DOCUMENTS

| | | | | |
|---|---|---|---|---|
| 3,859,969 | A * | 1/1975 | Davis, Jr. | 123/90.61 |
| 4,186,696 | A | 2/1980 | Linsenmann | |
| 4,436,063 | A * | 3/1984 | Usui | 123/90.61 |
| 4,453,505 | A | 6/1984 | Holtzberg et al. | |
| 4,589,384 | A * | 5/1986 | Ott | 123/90.55 |
| 4,954,462 | A | 9/1990 | Wood et al. | |
| 5,154,146 | A * | 10/1992 | Hagerman et al. | 123/90.61 |
| 5,230,308 | A | 7/1993 | Gauthier et al. | |
| 5,372,100 | A | 12/1994 | Bertelson | |
| 5,718,532 | A | 2/1998 | Mower | |
| 5,720,246 | A * | 2/1998 | Griffin et al. | 123/90.61 |

FOREIGN PATENT DOCUMENTS

| | | |
|---|---|---|
| GB | 1 343 983 | 1/1974 |
| JP | 57-013204 | 1/1982 |
| JP | 01-103964 | 4/1989 |
| WO | WO 97/21908 | 6/1997 |
| WO | WO 2004/056553 A1 | 7/2004 |

OTHER PUBLICATIONS

"New High Temperature Oxide Fibers", D.M. Wilson, Jan. 2002.
Statement by Applicants.

* cited by examiner

*Primary Examiner*—Thomas Denion
*Assistant Examiner*—Zelalem Eshete

(57) ABSTRACT

In one embodiment, the invention comprises a polymer matrix pushrod comprising a composite rod having an annular collar affixed over each end portion of the composite rod and an endcap affixed at each end. The composite rod comprises a thermosetting polymer matrix and reinforcing fibers within the polymer matrix.

30 Claims, 2 Drawing Sheets

POLYMER MATRIX COMPOSITE PUSHROD

BACKGROUND

This invention relates to composite pushrods and more specifically, to polymer matrix composite pushrods.

Overhead valve internal combustion engines typically employ a "valve train" which regulates the motion of valves used to control the flow of combustion and exhaust gases into and out of each engine cylinder. Among the numerous components of such valve trains are "pushrods" which serve, among other components, to convert rotating motion from the rotating camshaft of the engine into linear motion of the individual valves on each cylinder. It has long been recognized that improvements to the valve train can lead to significant improvements in overall engine performance. More particularly, valve train components of increased stiffness, reduced weight and/or improved vibration damping properties have been suggested as possible enhancements to lower engine noise, increase engine speed, increase engine power and improve fuel efficiency, particularly in high performance overhead valve engines.

Pushrods made using polymer matrix composite materials have been proposed as alternatives to traditional metal pushrods. In order to provide sufficient wear of the pushrod at its ends, separate endcaps typically of a harder material, such as a metal, were fitted at both ends.

Male endcaps have been used at the ends of polymer matrix pushrods to prevent failures of the composite rod. However, "brooming" of the ends of the composite rod or tube still could occur due to compression forces on the ends of the pushrods and splitting of the composite tube still could occur if a typical interference fit endcap pin were used.

Female endcaps, i.e., endcaps having a crown and a skirt that fits over the ends of the polymer composite rod, have been proposed to prevent brooming of the ends of the composite rod. Such female endcaps must typically be custom designed and fabricated for these applications. This is because most commercially available endcaps for various rod diameters, tip diameters, and tip designs are male rather than female. Also, adhesive bonds used to hold the female endcaps on the rod are typically less reliable than interference fit.

SUMMARY

In one embodiment, the invention comprises a polymer matrix pushrod comprising a composite rod having an annular collar affixed over each end portion of the composite rod and an endcap affixed at each end. The composite rod comprises a thermosetting polymer matrix and reinforcing fibers within the polymer matrix.

In one aspect of the above embodiment, the composite rod has a substantially uniform diameter along its length and the annular collars are affixed over the surfaces of the end portions of the composite rod.

In another aspect of the above embodiment, the annular collars are affixed over the end portions wherein the diameters of the end portions of the composite rod are such that the outside diameters of the annular collar are substantially the same as the outside diameter of the remainder of the composite rod.

In another embodiment, the invention comprises a polymer matrix pushrod comprising a composite rod comprising a thermosetting polymer matrix and reinforcing fibers within the polymer matrix, a sleeve affixed over the outside surface of the composite rod, and an endcap affixed at each end of the composite rod.

In another embodiment, the invention comprises a polymer matrix pushrod comprising a composite rod comprising a thermosetting polymer matrix and reinforcing fibers within the polymer matrix, annular collars are affixed over the end portions of the composite rod wherein the outside diameters of the annular collar are substantially the same as the outside diameter of the remainder of the composite rod, a sleeve affixed over the outside surface of the composite rod, and an endcap affixed at each end of the composite rod.

DETAILED DESCRIPTION

"Composite" as used herein means a combination of at least polymer matrix and reinforcing fibers on a macroscopic scale.

"Thermosetting polymer" means a polymer that solidifies or crosslinks irreversibly when heated or irradiated.

"Rod" includes solid and tubular or hollow rods.

"Fiber" as used herein includes monofilaments, tows, and yarns.

"Substantially continuous fiber" means a fiber that has a length of substantially the length of a composite rod.

Figure 1:
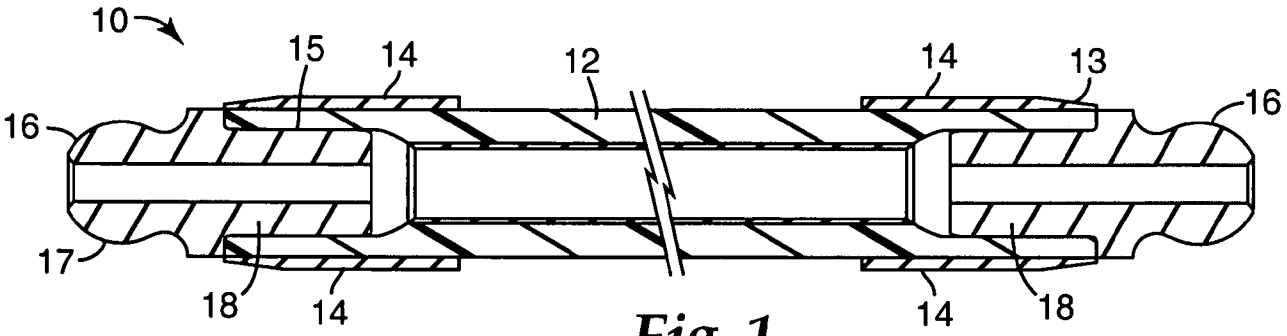
FIG. 1 is a schematic cross-sectional view of another embodiment of a polymer matrix composite pushrod of the invention

One embodiment of a pushrod of the invention is shown in FIG. 1 in cross-section. Pushrod 10 comprises a hollow composite rod 12 having annular collars 14 over the outside surface near the ends of the composite rod or end portions 18 and endcaps 16 at the ends of the composite rod 12. The composite rod 12 comprises a thermosetting polymer matrix and reinforcing fibers. Endcaps 16 have a crown 17 and a shank 18 depending therefrom and which fits inside the aperture 15 in the end of the composite rod 12. Such endcaps are also known as "male" endcaps. Endcaps 16 may be affixed to the ends of the composite rod by interference fit, adhesive bonding, or a combination of both, to the ends of the composite rod.

In the pushrod of the invention shown in FIG. 1, the outside diameter of the composite rod is substantially uniform over the length of the rod. Because the outside diameter of the rod is substantially uniform over its length, the annular collars 14 are external to the outside cylindrical surface of the composite rod, and have a larger outside diameter than that outside diameter of the composite rod. The annular collars have tapered ends 13 that are nearest the ends of the composite rod 12.

Although not required, such tapered ends on the annular collars may be needed to provide clearance between a rocker arm and the end of the pushrod. The annular collars may be affixed over the outside surface of the ends of the composite rod by interference fit or by using a suitable high strength adhesive, or a combination of both. The length of the annular collar when affixed to the end portions of the composite rod typically extends beyond the depth of the aperture for the shank. In one embodiment, the length of the annular collar extends beyond the depth of the aperture a length that is at least about the diameter of the shank. The annular collars on each end portion are typically two separate components as compared with a sleeve, described below.

The annular collars used over the outside surface near the ends of the composite rods inhibit splitting or "brooming" of the composite rod at and/or near the rod's ends. The annular collars on the composite rods near its ends may also provide physical interference for a durable and reliable attachment of a male endcap. Such an interference fit of the endcaps would likely not be possible without an annular collar that resists any outward forces on the composite rod during insertion of a male endcap. In turn, any outward force provided by the shank of the male endcap desirably also holds the annular collar in place.

Typically for the combination of composite rod, collar, and endcap to form a robust pushrod, the collar and endcap shank desirably fits around and within the composite rod within certain interference ranges. Typically, the collar should have a nominal interference of about 0.025 mm and not more than about 0.051 mm, with an interference range of from about 0.0000 mm to about 0.051 mm and any number or range in between. This means that the inside diameter of the annular collar is, for example, from about 0.0000 mm to about 0.051 mm smaller than the outside diameter of the composite rod where the annular collar is to be placed. Typically, the annular collars have a thickness sufficient to provide a robust pushrod for the intended application. In one embodiment, the thickness of the annular collar is at least about 0.024 in (0.061 cm).

Typically, the shank of the endcap should have a nominal interference of about 0.051 mm and not more than 0.0762 mm, with an interference range of from about 0.025 mm to about 0.0762 mm and any number or range in between.

Typically, the thickness of the wall of the composite rod that is between the annular collar and endcap shank is an effective thickness to prevent failure of the pushrod due to splitting, brooming, or loss of endcap or collar. Typically, this wall thickness is at least about 1 mm.

Useful annular collars include those made from metals, such as steel, stainless steel, hardened steel, aluminum, and titanium and metal alloys.

Useful composite rods for pushrods of the invention comprise a thermosetting polymer matrix and reinforcing fibers that are within or are embedded or substantially embedded within the polymer matrix. Desirably, the reinforcing fibers are substantially continuous. The substantially continuous reinforcing fibers are also desirably substantially unidirectional, that is, aligned substantially parallel to the central axis of the rod. Useful composite rods used in the pushrods of the invention have compression strength of at least 150 ksi (1030 MPa). In another embodiment, the composite rods used in pushrods of the invention have compression strength of at least about 250 ksi (1700 MPa).

Useful thermosetting polymer matrices comprise thermosetting polymers having a glass transition temperature (Tg) of at least about 300° F. (149° C.). In another embodiment, useful thermosetting polymer matrices comprise thermosetting polymers having a glass transition temperature (Tg) of at least about 400° F. (204° C.). Examples of such thermosetting polymers include, but are not limited to, epoxy resins, cyanate-esters, bismaleimides, phenolics, polyimides, and combinations thereof. A specific example of a useful thermosetting polymer is a two-part thermosetting resin sold under the tradename "MATRIMID 5292A" and "MATRIMID 5292 B" bismaleimide resin and curative (available from Huntsman Advanced Materials Americas, Inc, of Brewster, N.Y.) which has Tg of about 400° F. (204° C.).

Specific examples of fibers useful in the composite pushrods of the invention include those fibers which comprise polycrystalline ceramics, for example, polycrystalline alumina; boron; silicon carbide; glass; high modulus graphite; graphite; and aromatic polyaniides and combinations of such fibers. Useful commercially available fibers include those having the trade designation "NEXTEL 610" ceramic oxide fibers, "NEXTEL 650" ceramic oxide fibers, and "NEXTEL 720" ceramic oxide fibers (available from 3M Company, St. Paul, Minn.); "KEVLAR" fibers (available from DuPont, Wilmington, Del.); and boron and SiC fibers (available from Specialty Materials Corporation, Lowell, Mass.). Desirably, the reinforcing fibers have a tensile modulus of at least about 55 msi (380MPa).

Generally, the reinforcing fibers are present in the thermosetting matrix at a volume fraction of at least 55%. In other embodiments, the reinforcing fibers are present in the thermosetting matrix at a volume fraction of not more than 70%. In other embodiments, the reinforcing fibers are present in the thermosetting matrix at a volume fraction in a range of from about 55% to about 70% and any volume percentage and any range in between 55% and 70%. In other embodiments, the reinforcing fibers are present in the thermosetting matrix at a volume fraction in a range of about 60% to about 65%, and any volume percentage and any range in between 60% and 65%.

Typically, the endcaps for the pushrods of the invention are made from materials suitable for use in an engine. Desirably, the endcaps have a Rockwell C hardness of 55 or greater. Examples of suitable materials include metal alloys and metals, such as steel, stainless steel, hardened steel, and nitride-coated titanium; and ceramic materials. The endcaps may be the same or different at each end of the composite rod. The endcaps may also have holes for the passage of lubricant or coolant such as engine oil.

Figure 2:
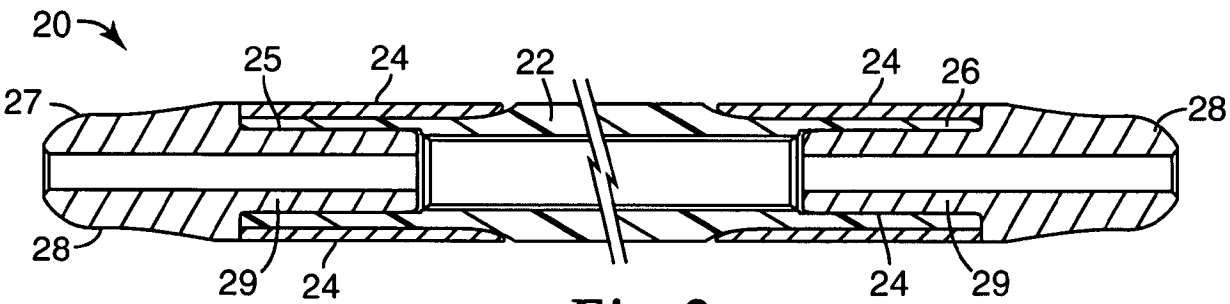
FIG. 2 is a schematic cross-sectional view of another embodiment of a polymer matrix composite pushrod of the invention.

FIG. 2 shows a pushrod 20 of the invention comprising a composite rod 22 comprising polymer matrix and reinforcing fibers with annular collars 24 affixed over the end portions 26 of the composite rod and endcaps 28 at each of the ends of the composite rod. Endcaps 28 have a crown 27 and a shank 29 depending therefrom and which fits inside the aperture 25 in the end of the composite rod 22. In this embodiment, the diameter of the end portions 26 of the composite rod 22 are such that when annular collars are adapted to fit over the end portions, the outside diameters of the annular collars 24 are substantially the same as the outside diameter of the remainder of the composite rod. Such a combination of smaller diameter end portions of the composite rod and annular collars provide "flush-fitted" annular collars. Such flush-fitted annular collars provide any needed clearance between a rocker arm or lifters and the end of the pushrod. The annular collars 24 may be affixed over the composite rod by means of interference fit, adhesive bonding, or a combination of both, to the smaller diameter end portions of the composite rod.

Figure 3:
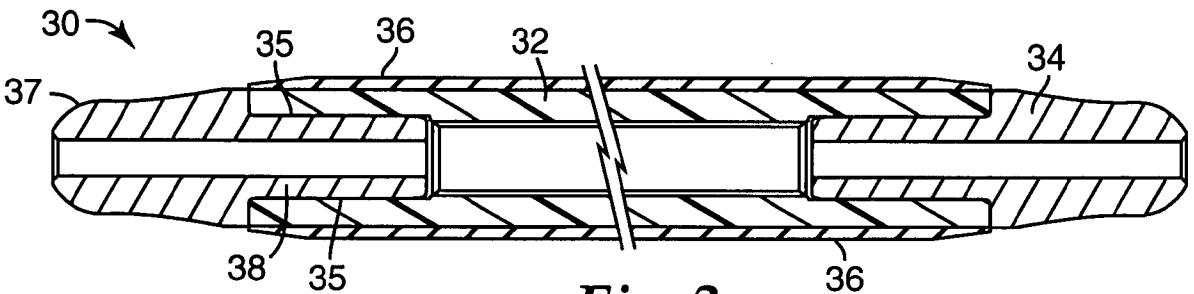
FIG. 3 is a schematic cross-sectional view of another embodiment of a polymer matrix composite pushrod of the invention.

In another embodiment, the pushrod 30 of FIG. 3 comprises a composite rod 32 and endcaps 34 at the ends of the composite rod. The composite rod 32 comprises a thermosetting polymer matrix and reinforcing fibers. Endcaps 34 have a crown 37 and a shank 38 depending therefrom and which fits inside the aperture 35 in the end of the composite rod 32. A metal sleeve 36 is affixed over the outside surface of substantially the entire length of the composite rod. The metal sleeve 36 inhibits splitting or "brooming" of the composite rod at and/or near the rod's ends. The metal sleeve may also provide physical interference for a durable and reliable attachment of a male endcap and provide protection of the composite rod in applications where the composite rod may rub against adjacent parts. The metal sleeve may be affixed over the composite rod by interference fit, adhesive bonding, or a combination of both.

The metal sleeve 36 may be comprised of metals, or metal alloys suitable for use in engines at typical engine temperatures. The metal sleeve may also be over the entire length or over only a portion of the length. The metal sleeve may also have a solid surface or may have discontinuities in its surface, for example, holes or slits.

Figure 4:
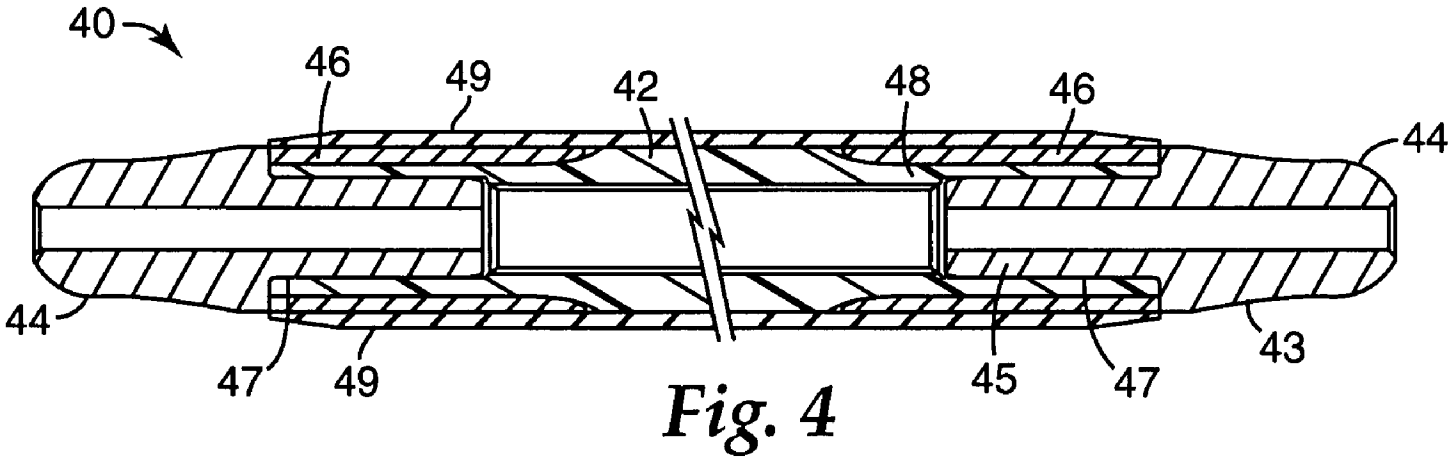
FIG. 4 is a schematic cross-sectional view of another embodiment of a polymer matrix composite pushrod of the invention.

In another embodiment, the pushrod 40 of FIG. 4 comprises a composite rod 42 and endcaps 44 at the ends of the rod, annular collars 46 affixed over the smaller diameter end portions 48 of the rod as in FIG. 2. Endcaps 44 have a crown 43 and a shank 45 depending therefrom and which fits inside the aperture 47 in the end of the composite rod 42. A metal sleeve 49 is affixed over the outside surface of substantially the entire length of the composite rod and including the outside surface of the annular collars. The metal sleeve may also be over the entire length or over only a portion of the length. The metal sleeve may be affixed over the composite rod by interference fit, adhesive bonding, or a combination of both.

Figure 5:
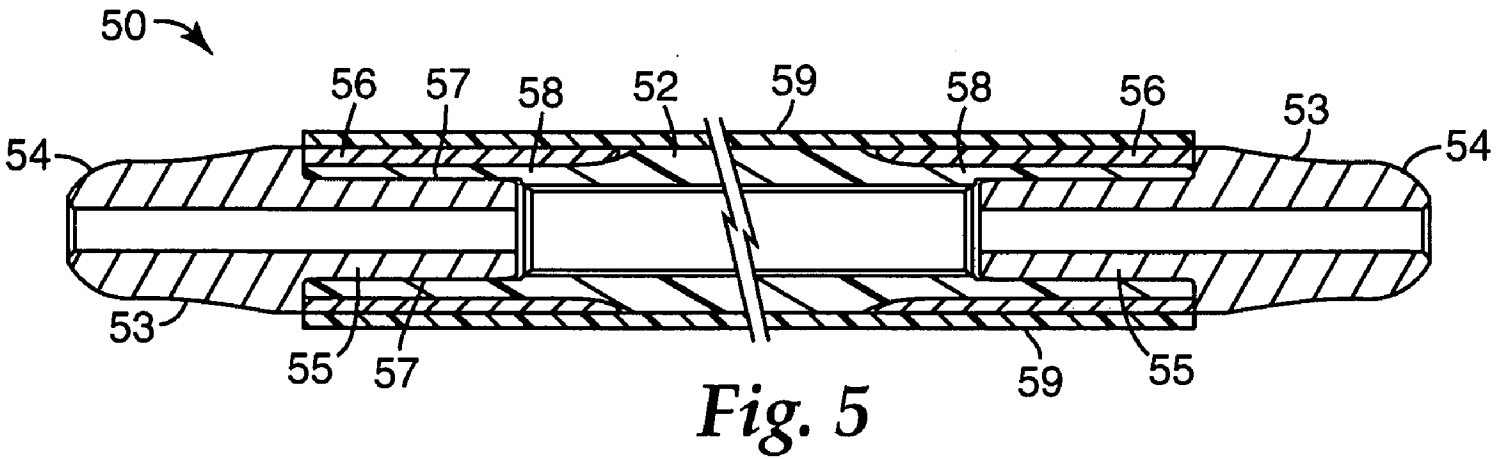
FIG. 5 is a schematic cross-sectional view of another embodiment of a polymer matrix composite pushrod of the invention.

In another embodiment, the pushrod 50 of FIG. 5 comprises a composite rod 52 and endcaps 54 at the ends of the rod, annular collars 56 over the smaller diameter end portions 58 of the composite rod as in FIG. 3. Endcaps 54 have a crown 53 and a shank 55 depending therefrom and which fits inside the aperture 57 in the end of the composite rod 52. A non-metallic sleeve 59 is affixed over the outside surface of substantially the entire length of the composite rod 52. Although the non-metallic sleeve is shown covering substantially the entire length, the non-metallic sleeve may also cover a portion or portions of the outside surface or surfaces of the composite rod. In this embodiment, the non-metallic sleeve 59 comprises a polymeric material. The non-metallic sleeve provides abrasion and cut resistance for the composite rod. The non-metallic sleeve also provides protection to any user or handler of a machined composite rod from any splinters caused from fiber exposure.

Useful polymeric materials for non-metallic sleeves include those that provide cut and abrasion resistance, are solvent and lubricant resistant, and can withstand operating temperatures of at least about 250° F. (121 C), and in other embodiments, at least about 350° F. (177 C). In another embodiment, the non-metallic sleeve comprises a heat-shrinkable polymer material. The non-metallic sleeves may be affixed to the composite rod by interference fit, adhesive bonding, or a combination of both.

The polymer matrix composite materials used in the present invention are generally made by forming a prepreg of fibers and thermosetting polymer resin, winding the prepreg around a mandrel, and then consolidating the prepreg to form a composite rod.

To achieve a desired surface finish and outside dimensions, the composite rod may be subjected to machining steps using, for example, a polycrystalline diamond-tipped cutting tool on a lathe, or a diamond-impregnated grinding apparatus. The composite rod either may have a constant diameter or it may be tapered or shaped in a manner such that the rod is thicker or has a larger diameter in portions of the rod. Alternatively, a grinder can be used to machine the composite rod to a desired dimension with a desired surface finish. The composite rods are each then cut to their desired length using, for example, a diamond-tipped cutter. The cut typically is a straight cut, made perpendicular to the long (central) axis of the pushrod.

EXAMPLES

Example 1

The prepreg material, which comprised 65% by volume alpha-alumina fiber (available under the trade designation "NEXTEL 610" from 3M Company; organic sized) and 35 percent by volume epoxy resin (obtained under the trade designation "EPON 828" from Resolution Performance Products, Houston, Tex.), was made by Aldila Corp, Poway, Calif. The prepreg had 10,000 denier tows of fiber spread at 10.42 tows per inch. A portion of prepreg (6.172 in (15.68 cm)×11.5 in (29.21 cm)); (24.13 g) was used.

Knowing the density of the epoxy resin (1.21 g/cc) and the "NEXTEL 610" (3.9 g/cc), the nominal ply thickness, when fully consolidated, was calculated to be 0.00692 in (0.176 mm). A piece of prepreg approximately 10.1 in (25.7 cm) wide was used to create a 0.375 in (0.95 cm) diameter pushrod.

The prepreg described above was wrapped around a stainless steel tube (0.202 in (0.51 cm) diameter; 0.010 in (0.254 mm) wall thickness; approximately 12-in (30.5 cm) long; available from MicroGroup, Medway, Mass.) such that the fibers are aligned longitudinally along the axis of the stainless steel tube. The prepreg was consolidated by wrapping in heat shrink plastic (available under the trade designation "CLYSAR HP" Shrink Wrap Film from DuPont, Wilmington, Del.) and placing it in an oven heated at 100–115° C. for about 30 minutes. The construction is cooled to room temperature (about 23° C.) and the heat shrink plastic is removed. Alpha-alumina fiber available under the trade designation "NEXTEL 550", available from 3M Company, was braided around the construction using a braiding machine (available from New England Butt Co., Providence, R.I.), yielding an article with a finished diameter of 0.380 in (0.976 cm).

The ensuing article was placed in a box furnace (Lindberg Blue M oven, Model 51732-1200° C. available from Lindberg, Watertown, Wis.) and heated at 700° C. for several minutes, thus burning away the epoxy resin and leaving the stainless steel tube and the Nextel fiber preform. The preform was placed into a custom-fabricated resin transfer mold aluminum die (0.375 in (0.95 cm) diameter×14 in (35.6 cm) length cavity) with a top and bottom half split along the centerline of the mold cavities.

Resin Injection:

The preform was placed into the aluminum die set and the entire assembly was placed in a Wabash hot press (with 15 in (38.1 cm)×15 in (38.1 cm) platen; available from Wabash MPI, Wabash, Ind.) at a clamping force of about 10,000 lbs (4,536 kg). On the inlet side of the die set, a metal tube connected the die set with the resin reservoir. The outlet side was connected with a metal tube to a vacuum pump (available from Sargent-Welch, Buffalo Grove, Ill.). The resin reservoir was filled with bismaleimide transfer molding resin available under the trade designation "651 RESIN"

resin transfer molding (RTM) compound from Hexcel Corp., Pleasanton, Calif. Heating tape (available from VWR Scientific, West Chester, Pa.) was wrapped around the resin reservoir and attached to a variable voltage power controller to heat the resin reservoir. Concurrently, the top and bottom platens of the hot press were heated to approximately 315° F. (157° C.). Insulation was positioned around the exposed sides of the aluminum die set to improve heating efficiency When the resin viscosity was reduced significantly (temperature above 200° F. (93° C.) the vacuum pump was turned on and the exhaust valve was opened. The vacuum pump thus pulled the air out of the mold and fiber preform. The inlet valve was opened causing the vacuum to pull the liquid resin from the reservoir into the mold cavity. After about three minutes, pressure (80 psi; 551.6 kPa) was applied to the inlet side and the inlet valve was opened. The resin immediately began to flow out the exhaust side of the die set and the exhaust valve was closed. The inlet side remained pressurized and the temperature set points on the hot-press platens were increased, raising the temperature to 350° F. (177° C.). The part was cured for 4 hours at 350° F. (177° C.).

Upon cooling, the pressure was released on the die set and the die set was opened. The finished pushrod was carefully ejected from the mold cavity. The sample pushrod was heated at 475° F. (246° C.) for 16 hours. The ends of the sample pushrod were cut perpendicular to the axis of the pushrod. Annular collars (4130 steel; inner diameter of 0.375 in (0.95 cm); outer diameter 0.438 in (1.1 cm); length 0.650 in (1.65 cm)) were adhesively bonded over the pushrod ends using high temperature epoxy, available under the trade designation "SCOTCHWELD 2214" from 3M Company. Holes were drilled longitudinally into the pushrod at each end to form apertures (approximately 0.220 in (0.558 cm) diameter) and a Smith Brothers endcap (0.3125 in (0.80 cm) ball-end with a 210 degree undercut and a 0.222 in (0.564 cm) diameter shank or pin, available from Smith Brothers Pushrods, Bend, Oreg., was pressed into each end using a mechanical, hand operated arbor press (available from Dake, Grand Haven, Mich.). The finished length of the sample pushrod measured from endcap to endcap was 9.450 in (24.0 cm). This preparation yielded a pushrod similar to that illustrated in FIG. 1.

Example 2

The epoxy-sized alpha-alumina fiber used in the following preparations was prepared as follows. A dilute sizing emulsion was prepared by combining "EPI-REZ 5003-W-55" waterborne epoxy resin (0.6 lb (0.27 kg)), with "EPI-REZ 5520-W-60" waterborne epoxy resin (2.4 lb (1.1 kg); both epoxy resins available from Resolution Performance Products, Houston, Tex.) and diluting with water (97.0 lb (44.0 kg)) with mechanical mixing. This dilute emulsion was then applied to alpha-alumina fiber available under the trade designation "NEXTEL 610", from 3M Company, using the following method:

A wound core of alpha-alumina fiber was mounted onto a unwind reel. The tow of fiber was then dip coated by passing the tow through a bath of the dilute sizing emulsion (at about 23° C.). Upon exiting the bath, the wet tow was spirally wound five times around two hot cans (10 in (25.5 cm) diameter×14 in (35.6 cm) length at 110° C.–120° C.). The resulting dry, epoxy-sized "NEXTEL 610" fiber coming off of the hot cans was wound up on a cardboard core (0.5% sizing by weight).

As in Example 1 above, the epoxy-sized fiber was converted to prepreg at Aldila Inc., Poway, Calif. (88 tows of 10,000 denier fiber were spread over 12 in (30.5 cm)) to produce a prepreg with a nominal fiber volume of 63–65% and nominal thickness (at full consolidated density) of 0.005 in (0.13 mm). Aldila used a bismaleimide resin to produce the prepreg. The resin was a blend of bismaleimide resin, available under the trade designation "MATRIMID 5292A" from Huntsman Advanced Materials Americas Inc., Brewster, N.Y. and co-reactant for bismaleimide resin, available under the trade designation "MATRIMID 5292B" also available from Huntsman Advanced Materials Americas Inc.

Consolidated hollow rods were produced by Aldila using normal state of the art techniques. Prepreg was wound around a tapered mandrel (approximately 0.2 in (5 mm) diameter with slight taper) and wound with heat-shrink plastic (available under the trade designation "CLYSAR HP" Shrink Wrap Film from DuPont, Wilmington, Del.). The wrapped articles were heated (at 350° F. (177° C.) for 2 hours; then 482° F. (250° C.) for 6 hours) causing the tape to shrink and the bismaleimide resin to cure. The resulting 24 polymer composite tubes were slid off the mandrel and ground to the desired diameter (half were ground to 0.375 in (0.95 cm) and half were ground to 0.438 in (1.1 cm)), each tube being about 18 in (45.7 cm) long. Pushrod blanks were cut from these 18 in (45.7 cm) long tubes, using perpendicular cuts.

The tube end portions were further machined to have tapered end portions (0.313 in (0.795 cm) diameter) to accept the annular collars and holes were drilled into each end (0.228 in (0.580 cm) diameter) to form apertures. The annular collars (outer diameter of 0.375 in (0.952 cm) and inner diameter of 0.313 in (0.795 cm) were pressed on the composite tube ends, followed by pressing in the endcaps (0.3125 in (0.80 cm) with 0.230 in (0.584) diameter shanks or pins, available under the trade designation TT3" from Comp Cams, Memphis, Tenn., produced by Trend Inc, Warren, Mich.). The annular collars and the endcaps were additionally secured by applying high temperature assembly adhesive (available under the trade designation "LOCTITE 648" from Loctite, Rocky Hill, Conn.). This preparation yielded a pushrod similar to that illustrated in FIG. 2.

Example 3

For the preparation of the pushrod of Example 3, the procedure described in Example 2 was followed with the exception that the composite rod had a starting diameter of 0.4375 in (1.1 cm) and tapers over two inches to 0.375 in (0.95 cm) at its ends.

Example 4

For the preparation of the pushrod of Example 4, the procedure described in Example 2 was followed with the exception that a thin walled (inner diameter of 0.375 in (0.953 cm) and an outer diameter of 0.438 in (1.113 cm)) 4130 steel sleeve (available from Aircraft Spruce, Corona, Calif.) was affixed over the outside surface of substantially the entire length of the composite rod (using Loctite 648 high temperature assembly adhesive (available form Loctite, Rocky Hill, Conn.) after the composite rod end portions were machined, but before the annular collars or endcaps were attached, yielding a pushrod similar to that illustrated in FIG. 4.

Example 5

For the preparation of the pushrod of Example 5, the procedure described in Example 4 was followed with the exceptions that the end portions of the composite rod were not machined, and the steel annular collars were not applied, yielding a pushrod similar to that illustrated in FIG. 3.

Example 6

For the preparation of the pushrod of Example 6, the procedure described in Example 2 was followed. Then heat shrink tubing, available under the trade designation "3M KYNAR TUBING" from 3M Company, was cut to length and slid over the pushrod, followed by heating to approximately 175° C., in order to shrink the tubing snuggly down to the pushrod yielding a pushrod similar to that shown in FIG. 5.

Foreseeable modifications and alterations of this invention will be apparent to those skilled in the art without departing from the scope and spirit of this invention. This invention should not be restricted to the embodiments that are set forth in this application for illustrative purposes.

What is claimed is:

1. A pushrod comprising:

a composite rod having first and second ends and first and second end portions and has a length defined by first and second end portions and a remainder portion, each of the end portions and the remainder portion having an outside diameter and outside surface comprising a thermosetting polymer matrix and reinforcing fibers within the polymer matrix;

an annular collar affixed over each end portion of the composite rod, the annular collars each having an outside surface and an outside diameter; and the diameters of the end portions of the composite rod are such that the outside diameters of the annular collars are substantially the same as the outside diameter of the remainder of the composite rod; and an endcap affixed at each end of the composite rod, wherein the fibers are selected from the group consisting of those fibers which comprise polycrystalline ceramics, boron, silicon carbide, aromatic polyamides, and combinations of such fibers.

2. The pushrod of claim 1 wherein the composite rod is hollow.

3. The pushrod of claim 1 wherein the composite rod is solid.

4. The pushrod of claim 1 wherein the fibers are substantially continuous.

5. The pushrod of claim 4 wherein the substantially continuous fibers are unidirectionally aligned substantially parallel to the central axis of the composite rod.

6. The pushrod of claim 1 wherein the fibers have a tensile modulus of at least about 380 MPa.

7. The pushrod of claim 1 wherein the composite rod has a compression strength of at least about 1030 MPa.

8. The pushrod of claim 1 wherein the thermosetting polymer matrix comprises thermosetting polymers having a glass transition temperature (Tg) of at least about 149° C.

9. The pushrod of claim 1 wherein the endcaps comprise metal.

10. The pushrod of claim 1 wherein the annular collars comprise metal.

11. The pushrod of claim 1 wherein the endcaps are affixed to the composite rod by interference fit.

12. The pushrod of claim 1 wherein the composite rod has a length and has an outside diameter and the outside diameter of the composite rod is substantially uniform over the length of the composite rod.

13. The pushrod of claim 1 further having a sleeve over the outside surface of substantially the entire length of the composite rod.

14. The pushrod of claim 13 wherein the sleeve is a metal sleeve.

15. The pushrod of claim 13 wherein the sleeve is a non-metallic sleeve.

16. The pushrod of claim 1 wherein the composite rod has a compression strength of at least about 1700 MPa.

17. The pushrod of claim 1 wherein the sleeve is a metal sleeve and the metal sleeve is affixed over the outside surface of the composite rod by interference fit.

18. A pushrod comprising:

a composite rod having first and second ends and first and second end portions comprising a thermosetting polymer matrix and reinforcing fibers within the polymer matrix;

an annular collar affixed over each end portion of the composite rod; and an endcap affixed at each end of the composite rod, wherein the composite rod has a length defined by first and second end portions and a remainder portion, each of the end portions and the remainder portion having an outside diameter and outside surface; the annular collars each have an outside surface and an outside diameter; and the diameters of the end portions of the composite rod are such that the outside diameters of the annular collars are substantially the same as the outside diameter of the remainder of the composite rod.

19. The pushrod of claim 18 wherein the composite rod is hollow.

20. The pushrod of claim 18 wherein the thermosetting polymer matrix comprises thermosetting polymers having a glass transition temperature (Tg) of at least about 149° C.

21. The pushrod of claim 18 wherein the sleeve is a metal sleeve and the metal sleeve is affixed over the outside surface of the composite rod by interference fit.

22. The pushrod of claim 18 wherein the endcaps comprise metal.

23. The pushrod of claim 18 wherein the composite rod is solid.

24. The pushrod of claim 18 wherein the fibers are substantially continuous.

25. The pushrod of claim 24 wherein the substantially continuous fibers are unidirectionally aligned substantially parallel to the central axis of the composite rod.

26. The pushrod of claim 18 wherein the fibers have a tensile modulus of at least about 380 MPa.

27. The pushrod of claim 18 further having a sleeve over the outside surface of substantially the entire length of the composite rod.

28. The pushrod of claim 27 wherein the sleeve is a metal sleeve.

29. The pushrod of claim 27 wherein the sleeve is a non-metallic sleeve.

30. The pushrod of claim 18 wherein the composite rod has a compression strength of at least about 1700 MPa.

* * * * *

UNITED STATES PATENT AND TRADEMARK OFFICE

CERTIFICATE OF CORRECTION

PATENT NO. : 7,077,091 B2
APPLICATION NO. : 10/950076
DATED : July 18, 2006
INVENTOR(S) : Leland E. Hix It is certified that error appears in the above-identified patent and that said Letters Patent is hereby corrected as shown below:

Column 4,
Line 14, delete “polyaniides” and insert in place thereof -- polyamides --.

Column 8,
Line 37, delete “TT3” ” and insert in place thereof -- “TT3” --.

Signed and Sealed this

Tenth Day of April, 2007

JON W. DUDAS
*Director of the United States Patent and Trademark Office*